US008424652B2

(12) United States Patent
Gieras et al.

(10) Patent No.: US 8,424,652 B2
(45) Date of Patent: Apr. 23, 2013

(54) ELECTROMAGNET AND ELEVATOR DOOR COUPLER

(75) Inventors: Jacek F. Gieras, Glastonbury, CT (US); Sastry V. Vedula, Loves Park, IL (US); Pei-Yuan Peng, Ellington, CT (US); Bryan Siewert, Westbrook, CT (US)

(73) Assignee: Otis Elevator Company, Farmington, CT (US)

( * ) Notice: Subject to any disclaimer, the term of this patent is extended or adjusted under 35 U.S.C. 154(b) by 936 days.

(21) Appl. No.: 12/524,382

(22) PCT Filed: Mar. 23, 2007

(86) PCT No.: PCT/US2007/064762

§ 371 (c)(1),
(2), (4) Date: Jul. 24, 2009

(87) PCT Pub. No.: WO2008/118165

PCT Pub. Date: Oct. 2, 2008

(65) Prior Publication Data

US 2009/0314588 A1 Dec. 24, 2009

(51) Int. Cl.

| | |
|---|---|
| ***B66B 13/02*** | (2006.01) |
| ***E06B 3/46*** | (2006.01) |
| ***E05F 17/00*** | (2006.01) |
| ***H01F 7/06*** | (2006.01) |

(52) U.S. Cl.
USPC ..... 187/319; 187/330; 307/104; 335/296; 49/120; 49/370

(58) Field of Classification Search ..... 187/319, 187/330; 49/116, 120, 370; 335/296; 307/104; *B66B 13/02; E06B 3/46; E05F 3/22,17/00; H01F 7/06, 7/13*
See application file for complete search history.

(56) References Cited

U.S. PATENT DOCUMENTS

| | | | |
|---|---|---|---|
| 1,344,430 | A | 6/1920 | Wigmore |
| 2,925,538 | A | 2/1960 | Rasmusen |
| 3,185,909 | A | 5/1965 | Jahn |
| 4,185,261 | A | 1/1980 | Nagata |

(Continued)

FOREIGN PATENT DOCUMENTS

| | | |
|---|---|---|
| GB | 2103423 A | 2/1993 |
| JP | 5166974 | 11/1949 |

(Continued)

OTHER PUBLICATIONS

International Search Report and Written Opinion of the International Searching Authority for International application No. PCT/US2007/064762 mailed Dec. 14, 2007.

(Continued)

*Primary Examiner* — William A Rivera
*Assistant Examiner* — Stefan Kruer
(74) *Attorney, Agent, or Firm* — Carlson, Gaskey & Olds PC

(57) ABSTRACT

An electromagnetic coupling device includes a vane member and an electromagnet. The electromagnet includes a core having a plurality of poles comprising at least four poles. An electrically conductive winding has a first portion surrounding a first one of the poles and a second portion surrounding a second one of the poles. The winding is selectively energized for selectively magnetically coupling the electromagnet and the vane member such that the vane member and the electromagnet are movable together in a desired direction.

17 Claims, 3 Drawing Sheets

U.S. PATENT DOCUMENTS

| | | | | |
|---|---|---|---|---|
| 4,315,171 | A * | 2/1982 | Schaeffer | 310/49.53 |
| 5,174,417 | A * | 12/1992 | Pilsbury | 187/330 |
| 5,487,449 | A * | 1/1996 | Barrett et al. | 187/330 |
| 7,592,720 | B2 * | 9/2009 | Busch | 310/12.24 |
| 2007/0001519 | A1 * | 1/2007 | Jeong et al. | 310/12 |

FOREIGN PATENT DOCUMENTS

| | | | |
|---|---|---|---|
| JP | 52127252 | | 3/1951 |
| JP | 59156076 | | 10/1984 |
| JP | 7309564 | A | 11/1995 |
| JP | 2004018200 | A | 1/2004 |
| WO | WO 2006074783 | A1 * | 7/2006 |

OTHER PUBLICATIONS

International Preliminary Report on Patentability for International application No. PCT/US2007/064762 mailed Jun. 9, 2009.

* cited by examiner

ELECTROMAGNET AND ELEVATOR DOOR COUPLER

BACKGROUND

Elevators typically include a car that moves vertically through a hoistway between different levels of a building. At each level or landing, a set of hoistway doors are arranged to close off the hoistway when the elevator car is not at that landing. The hoistway doors open with doors on the car to allow access to or from the elevator car when it is at the landing. It is necessary to have the hoistway doors coupled appropriately with the car doors to open or close them.

Conventional arrangements include a door interlock that typically integrates several functions into a single device. The interlocks lock the hoistway doors, sense that the hoistway doors are locked and couple the hoistway doors to the car doors for opening purposes. While such integration of multiple functions provides lower material costs, there are significant design challenges presented by conventional arrangements. For example, the locking and sensing functions must be precise to satisfy codes. The coupling function, on the other hand, requires a significant amount of tolerance to accommodate variations in the position of the car doors relative to the hoistway doors. While these functions are typically integrated into a single device, their design implications are usually competing with each other.

Conventional door couplers include a vane on the car door and a pair of rollers on a hoistway door. The vane must be received between the rollers so that the hoistway door moves with the car door in two opposing directions (i.e., opening and closing). Common problems associated with such conventional arrangements is that the alignment between the car door vane and the hoistway door rollers must be precisely controlled. This introduces labor and expense during the installation process. Further, any future misalignment results in maintenance requests or call backs.

It is believed that elevator door system components account for approximately 50% of elevator maintenance requests and 30% of callbacks. Almost half of the callbacks due to a door system malfunction are related to one of the interlock functions.

There is a need in the industry for an improved arrangement that provides a reliable coupling between the car doors and hoistway doors, yet avoids the complexities of conventional arrangements and provides a more reliable arrangement that has reduced need for maintenance. One proposal has been to replace mechanical components with electromagnetic components. Examples of electromagnetic arrangements are shown in U.S. Pat. Nos. 6,070,700; 5,487,449; 5,174,417; and 1,344,430.

A significant challenge facing a designer of any new elevator door coupler is that the entire arrangement, whether mechanical or electromagnetic, must fit within the tight space constraints mandated by codes. For example, an elevator door coupler arrangement must leave a 6.5 mm minimum clearance between the car door sill and the coupler components on a hoistway door. At the same time a 6.5 mm minimum clearance must be maintained between the hoistway door sill and the coupler components on the car. The total gap between a typical car door sill and a typical hoistway door sill is about 25 mm (one inch). Such space constraints place limitations on the type of components that can be used as an elevator door coupler and make it particularly challenging to realize electromagnetic couplers having sufficient attractive force to maintain a desired coupling between the doors. Therefore, strategic arrangement of parts becomes necessary to implement elevator door coupling techniques.

SUMMARY

An exemplary electromagnetic coupling device includes an electromagnet and a vane member that is selectively magnetically coupled with the electromagnet. The electromagnet comprises a ferromagnetic core having a plurality of poles comprising at least four poles and an electrically conductive winding having a first portion surrounding a first one of the poles and a second portion surrounding a second one of the poles. The winding is selectively energized for selectively magnetically coupling the electromagnet and the vane member such that the vane member and the electromagnet are moveable together in a desired direction.

The various features and advantages of the disclosed examples will become apparent to those skilled in the art from the following detailed description. The drawings that accompany the detailed description can be briefly described as follows.

DETAILED DESCRIPTION

Figure 1:
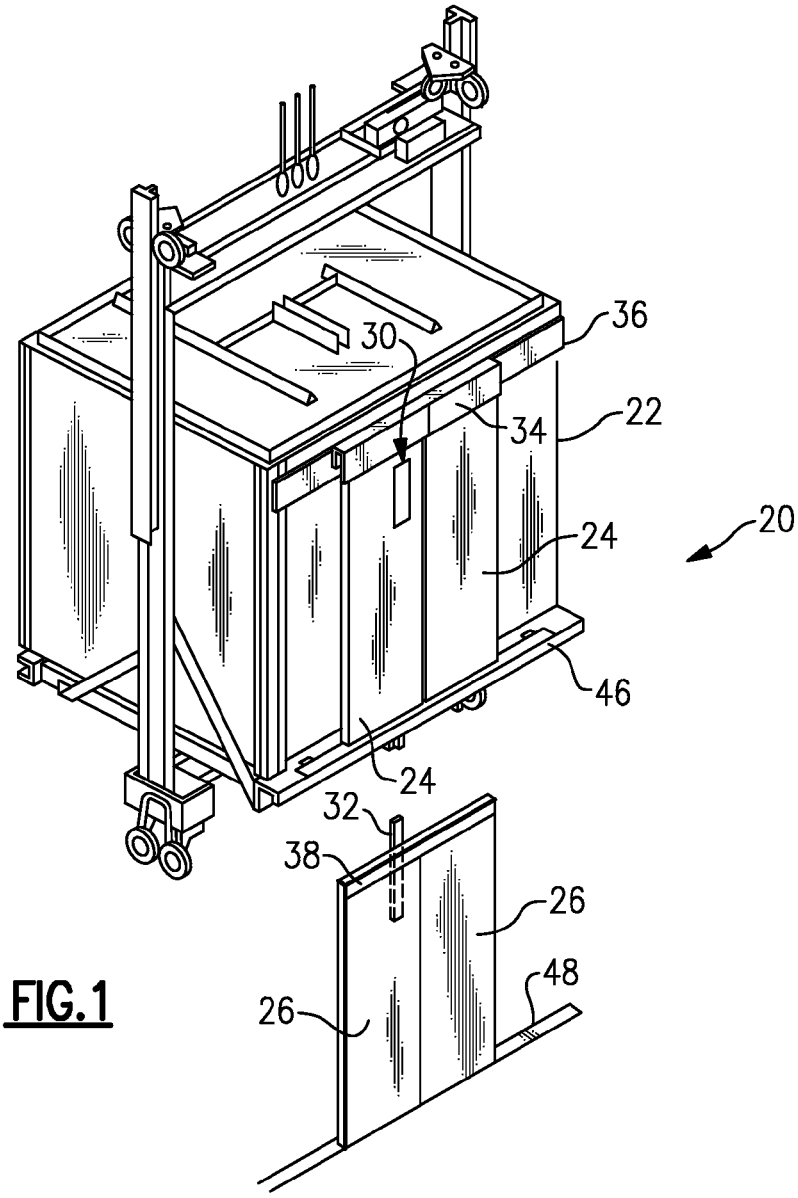
FIG. 1 schematically illustrates selected portions of an elevator system.

FIG. 1 schematically shows an elevator door assembly 20 that includes a unique door coupler. An elevator car 22 has car doors 24 that are supported for movement with the car through a hoistway, for example. The car doors 24 become aligned with hoistway doors 26 at a landing, for example, when the car 22 reaches an appropriate vertical position.

The illustrated example includes a door coupler to facilitate moving the car doors 24 and the hoistway doors 26 in unison when the car 22 is appropriately positioned at a landing. In this example, the door coupler includes an electromagnet 30 associated with at least one of the car doors 24. At least one of the hoistway doors 26 has an associated vane 32 that cooperates with the electromagnet 30 to keep the doors 26 moving in unison with the doors 24 as desired.

In the illustrated example, the electromagnet 30 is supported on a door hanger 34 that cooperates with a track 36 in a known manner for supporting the weight of an associated door and facilitating movement of the door. The vane 32 in this example is supported on a hoistway door hanger 38.

Figure 2:
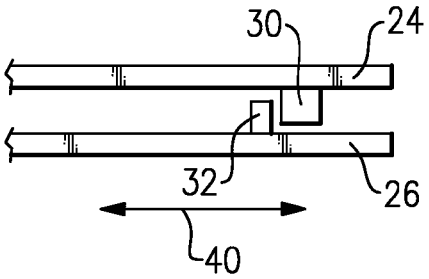
FIG. 2 schematically illustrates operation of an example coupler device.

As can be appreciated from FIG. 2, when the electromagnet 30 is selectively energized while the elevator car 22 is at an appropriate landing, the electromagnet 30 and the vane member 32 are magnetically coupled. The attractive force associated with the magnetic coupling is sufficient to keep the electromagnet 30 and the vane member 32 moving together to cause a desired movement in unison of the car door 24 and the hoistway door 26, as schematically shown by the arrow 40. The arrow 40 represents door movement between open and closed positions.

The tight dimensional constraints on elevator door coupler arrangements include limited spacing between the sills 46 and 48. The illustrated example includes a unique electromagnet 30 that provides an attractive, magnetic force sufficient for coupling the electromagnet 30 with the vane 32 so that the elevator doors 24 and 26 are appropriately coupled together to move in unison when desired.

Figure 3A:
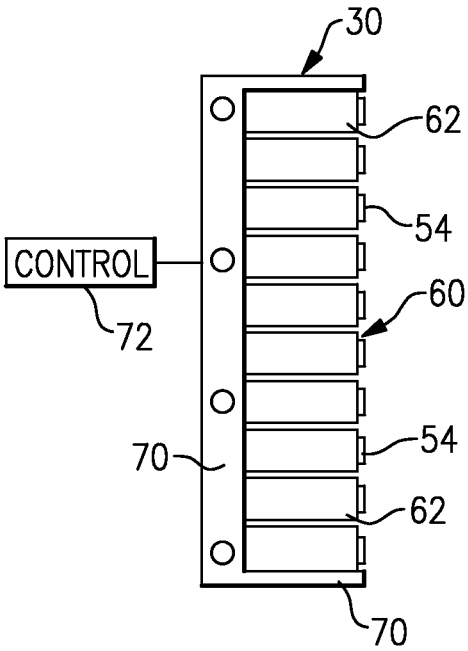
FIGS. 3A and 3B schematically show an example electromagnet arrangement in two elevational views.
Figure 3B:
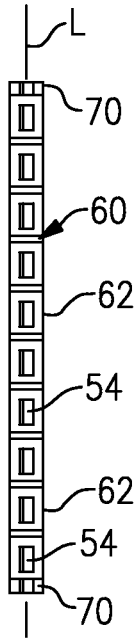
Figure 4:
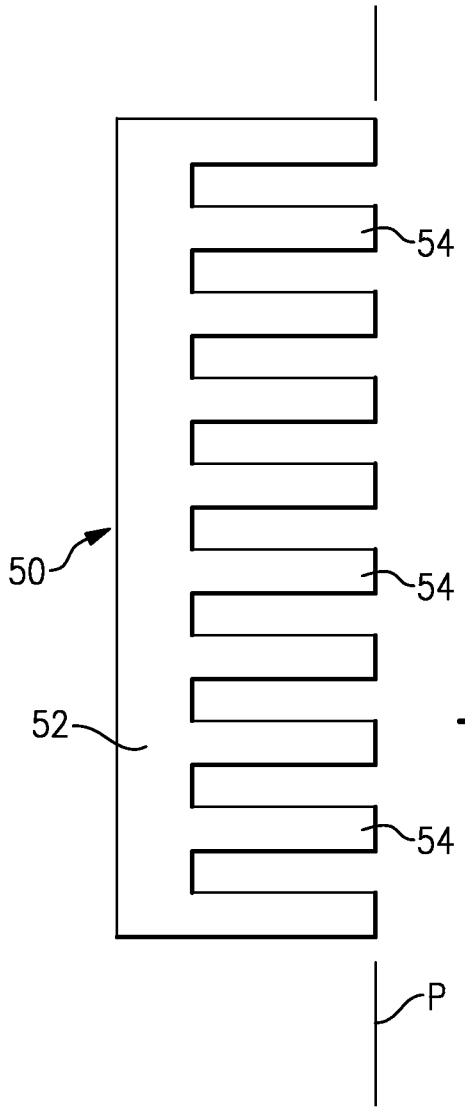
FIG. 4 is a schematic, elevational illustration of an example core.

As can be appreciated from FIGS. 3A, 3B and 4, an example electromagnet 30 includes a core 50. A ferromagnetic material such as steel or a sintered powder is used for making the core 50 in some examples. The core is a single piece in one example. In another example, the core 50 comprises laminated pieces. The example core 50 includes a bridge portion 52 along one side of the core 50. A plurality of poles 54 are spaced from each other and supported by the bridge portion 52.

At least one winding 60 includes a plurality of portions 62 that generally surround at least some of the poles 54. In the example of FIGS. 3A and 3B, every pole 54 has an associated portion 62 of the winding 60 surrounding it. In another example, the outermost poles 54 do not include any winding portion on them.

The example of FIGS. 3A and 3B includes a non-magnetic frame portion 70 that provides an encapsulation of at least some sides of the electromagnet 30. The non-magnetic frame portion 70 leaves the poles 54 exposed as schematically shown. One feature of the illustrated frame portion 70 is that it provides potting of the electromagnet 30. Such an encapsulation improves heat transfer between the winding 60, the core 50 and the surrounding environment. At the same time, the encapsulation strengthens the insulation system to withstand any over-voltages when current to the electromagnet 30 is interrupted, for example.

The illustrated electromagnet 30 includes a plurality of poles 54 comprising at least four poles 54. Such an arrangement has several advantages. One advantage is that the electromagnetic design can be very compact and, in particular, can be very thin so that it can fit within the tight space constraints of an elevator system so that the electromagnet 30 can be used as an effective door coupler. Providing at least four poles allows for a compact design that is still capable of generating sufficient magnetic attractive forces to achieve a reliable coupling for door movement.

Having winding portions 62 surrounding the poles 54 allows for all sides of each winding portion 62 to participate in production of the magnetic flux and attractive force that is used for magnetically coupling the electromagnet 30 and the vane member 32. Having multiple poles 54 and multiple winding portions 62 reduces the amount of copper wire required. Heat transfer from the winding 60 can be improved where the winding portions 62 are kept thin. Any leakage flux is reduced because the pole-to-pole surface area is relatively small. The illustrated example avoids leakage flux that may otherwise occur between an electromagnet's poles and a steel door hanger associated with the elevator door, for example. Additionally, the relatively smaller amount of metal materials used to make the electromagnet 30 render it relatively lightweight.

A number of poles to select will depend on the particular configuration. Those skilled in the art who have the benefit of this description will be able to select an appropriate number of poles and size of the electromagnet 30 components to meet their particular needs. In general, an even number of poles is desired to obtain a closed loop (e.g., from north to south). The spacing between the winding portions 62 in one example is kept as small as possible without reducing the performance of the electromagnet 30. A minimal spacing is desired that does not incur an undesirable amount of leakage flux so that the magnetic flux generated by energizing the winding 60 can be used as much as possible for a magnetic attraction force for coupling the electromagnet 30 to the vane member 32.

As can be appreciated in FIG. 3B, all of the poles 54 in the illustrated example are aligned with each other in a straight line L and all are parallel to each other. Terminal ends on the poles 54 that are distal from the bridge portion 52 (in the example of FIG. 4) are positioned so that each end lies in a common plane P with the ends of all other poles 54. The ends of the poles 54 are oriented when the electromagnet 30 is installed so that they face toward the vane member 32. The length of the electromagnet 30 (e.g., from top to bottom in FIG. 3B) will depend on the number and size of the poles 54 selected for a particular configuration. The width (e.g., from right to left in FIG. 3B) of the electromagnet 30 can be as small as 11 mm, for example, which renders the electromagnet 30 thin enough to fit within the tight space constraints associated with an elevator door system.

FIG. 3A schematically shows a controller 72 that controls how the winding 60 is energized to control operation of the electromagnet. In one example, the controller 72 selectively energizes the winding 60 using a first power level during an initial magnetic coupling between the electromagnet 30 and the vane member 32. Using a relatively lower energization level allows, for example, for the attraction force to be controlled in a manner that reduces any banging noise associated with the magnetic coupling between the electromagnet 30 and the vane member 32. Additionally, using a relatively lower attracting force during an initial coupling reduces the wear of contact areas between the electromagnet 30 and the vane member 32 during any re-leveling of the elevator car at the landing, which may be associated with loading or unloading the car, for example.

Once the initial coupling is established, the controller 72 in one example energizes the winding 60 with a second, higher power level to create a higher magnetic attraction force (e.g., more magnetic flux) for maintaining a desired coupling between the electromagnet 30 and the vane member 32 to achieve moving the elevator car door 24 and the hoistway door 26 in unison as desired.

In some examples, each winding portion 62 comprises a separate coil that can be individually energized by the controller 72. In such an example, the controller 72 selectively energizes only at least a selected one of the winding portions 62 during the initial portion of establishing a magnetic coupling between the electromagnet 30 and the vane 32. By selecting the number of coil portions 62 to be energized, the controller 72 can selectively vary the magnetic attractive force generated by the electromagnet 30.

Figure 5:
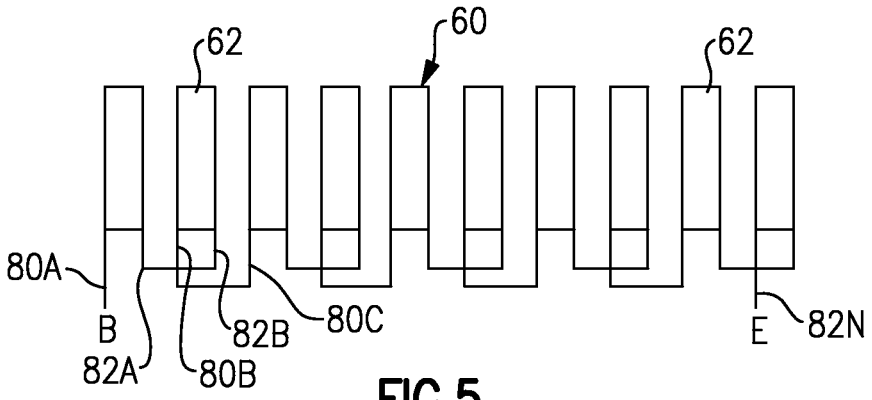
FIG. 5 schematically illustrates an example winding configuration.

FIG. 5 schematically shows one example arrangement where the winding 60 comprises a plurality of individual coil portions 62 where each pole 54 can be considered to have its own winding comprising the respective winding portion 62. In the example of FIG. 5, each winding portion 62 has two ends or leads 80 and 82. One of the leads 80A can be considered a beginning lead for a first one of the winding portions 62. The other lead 82A can be considered the end of that winding portion. In the example of FIG. 5, the winding portions 62 are connected in a series arrangement so that the lead 82A is electrically coupled with the lead 82B of an adjacent winding portion. The lead 80B is then electrically coupled with the lead 80C and so on until the final end 82N is left for a connection to an appropriate power source so that energization can be controlled by the controller 72. A series arrangement of coupling individual winding portions 62 is desirable in some examples to minimize inter-coil currents which may contribute to increased power consumption and increased temperatures. Other examples include a parallel connection between the ends 80, 82 of the winding portions 62 to provide selectively energizing of some of the winding portions as described above. Another advantage to a parallel electrical coupling between the winding portions 62 is that even if one of the winding portions 62 should fail, others are still available for generating magnetic flux to provide an attractive force for coupling the electromagnet 30 to the vane member 32.

The example of FIG. 4 shows a single piece core 50. Other examples include modular, multiple piece cores. The example of FIG. 6 includes a core 50 having a plurality of core pieces 90 that each include two pole portions 54. A plurality of connectors 92 are used to secure the core pieces 90 together as shown. In this example, the connectors 92 comprise externally threaded members that are received within internally threaded recesses 94 in the core pieces 90 as shown. In one example, a threaded member 92 is threaded into one of the recesses 94 and then an adjacent core piece 90 is threaded onto a remainder of the connector 92. Such a process can be repeated until the desired number of core pieces 90 are secured together.

Figure 6:
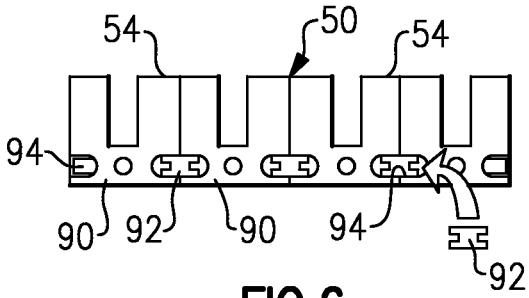
FIG. 6 schematically shows an example modular core.

In the example of FIG. 6 the pole portions of adjacent core pieces 90 are received immediately adjacent each other so that a pole portion of one piece 90 cooperates with a pole portion of an adjacent piece 90 to establish a single pole 54 as can be appreciated from the drawing.

Figure 7:
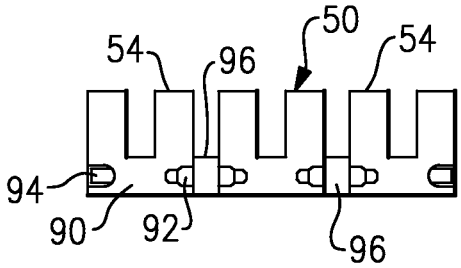
FIG. 7 shows another example core.

FIG. 7 shows another example arrangement where the core pieces 90 are secured together including spacer members 96 between them to maintain a spacing between each pole portion. In this example, each pole portion on each core piece 90 constitutes an individual pole 54.

One advantage to a modular approach as schematically shown in FIGS. 6 and 7, for example, is that it is possible to customize the size of the electromagnet 30 in a relatively easy and economical manner. The desired number of core pieces 90 can be assembled together to establish the desired number of poles 54. Individual winding portions 62 can then be placed onto each pole 54. Alternatively, the core pieces 90 may be preloaded with winding portions 62 having ends 80 and 82 that can then be connected in a series or parallel arrangement.

The disclosed examples include several advantages including reducing the maintenance and callbacks relating to door locking coupling and sensing functions, in part, because the number of mechanical components is reduced compared to previous arrangements. Additionally, the disclosed examples allow for saving hardware costs compared to mechanical door coupler arrangements. One example includes a cost savings of approximately 30% compared to some traditional arrangements. The electromagnetic coupling aspect of the disclosed examples allows for reduced installation time and can eliminate field adjustment time during an elevator system installation. The tolerance for positioning the electromagnet 30 and the vane member 32 is greater than that associated with traditional mechanical arrangements so that the electromagnet 30 and vane member 32 may be installed in a factory setting on corresponding door components. The doors can then be installed onsite where the elevator system will be in use without requiring adjustment in the field to achieve the desired interaction between the electromagnet 30 and the vane member 32.

The disclosed examples are well suited for fitting within the space requirements between an elevator car door and a hoistway door. At the same time, the disclosed examples allow for providing a high attractive magnetic force to ensure a reliable coupling for moving the doors in unison. Additionally, power consumption is lower and generated temperatures are lower by using the plurality of poles and winding portions as described above.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An electromagnetic coupling device, comprising:

a vane member; and an electromagnet including a core having a plurality of poles comprising at least four poles, the core comprising a plurality of core pieces each having at least two poles and a bridge portion near one end of the poles, the core comprising a connector between two of the core pieces for holding the two core pieces together; and an electrically conductive winding having a first portion surrounding a first one of the poles and a second portion surrounding a second one of the poles, the winding being selectively energized for selectively magnetically coupling the electromagnet and the vane member to resist relative movement between the electromagnet and the vane member such that the vane member and the electromagnet are moveable together in a desired direction.

2. The device of claim 1, wherein each pole has an end facing in a direction of the vane member, each of the pole ends is at least partially in a common plane with all of the other pole ends.

3. The device of claim 2, wherein the pole ends are all aligned along a straight line within the common plane.

4. The device of claim 1, wherein the winding comprises a plurality of windings such that each said portion of the winding comprises an individual winding having a first end and a second end.

5. The device of claim 4, wherein the ends of the individual windings are electrically coupled together such that the individual windings are in parallel with each other.

6. The device of claim 4, wherein the ends of the individual windings are electrically coupled together such that the individual windings are in series with each other.

7. The device of claim 1, comprising a controller configured to control an amount of electrical energy provided to the winding to control an attractive force for magnetically coupling the core and the vane member.

8. The device of claim 7, wherein the controller is configured to selectively energize only at least one selected portion of the winding without energizing at least one other portion while initiating a magnetic coupling between the electromagnet and the vane member; and selectively energize the at least one other portion of the winding for establishing a relatively stronger magnetic coupling between the electromagnet and the vane member.

9. The device of claim 1, wherein each of the poles has an associated portion of the winding.

10. The device of claim 1, wherein the connector comprises a threaded member that is at least partially received in a correspondingly threaded recess on each of the core pieces.

11. The device of claim 1, wherein the core pieces are received against each other such that a pole on one of the core pieces is immediately adjacent a pole on the other core piece such that the immediately adjacent poles act as a single pole of the core.

12. The device of claim 1, wherein the connector comprises a spacer received between the core pieces such that there is a spacing between a pole on one of the core pieces and an adjacent pole on the other of the core pieces.

13. The device of claim 1, wherein the poles are aligned in a generally straight line and the portions of the winding surround the corresponding poles such that a plurality of sides of each of the winding portions participates in generating a magnetic flux and an associated magnetic attractive force for magnetically coupling the electromagnet and the vane member.

14. The device of claim 1, comprising a non-magnetic frame along at least one side of the core that is distal from the vane member.

15. The device of claim 1, wherein the winding portions at least partially surround the corresponding poles such that a plurality of sides of each winding portion is exterior to the corresponding pole and wherein each of the plurality of sides of each portion is active in producing a magnetic flux for magnetically coupling the electromagnet and the vane member.

16. The device of claim 1, wherein the controller is configured to selectively energize the winding at a first level for generating an initial magnetic attraction force for initiating a magnetic coupling between the electromagnet and the vane member; and selectively energizing the winding at a second, higher level for establishing a relatively stronger magnetic coupling between the electromagnet and the vane member.

17. The device of claim 1, comprising an elevator car door;

a hoistway door; and wherein the electromagnet is supported on one of the elevator car door or the hoistway door and the vane member is supported on the other one of the hoistway door or the elevator car door and wherein a magnetic coupling between the electromagnet and the vane member is operative to associate the elevator car door and the hoistway door so that the doors move in unison.

* * * * *